US009522689B2

(12) United States Patent
Kubo

(10) Patent No.: US 9,522,689 B2
(45) Date of Patent: Dec. 20, 2016

(54) DIAGRAM CREATING DEVICE, DIAGRAM CREATING METHOD, AND DIAGRAM DISPLAY PROGRAM

(71) Applicants: Kabushiki Kaisha Toshiba, Minato-ku (JP); Toshiba Solutions Corporation, Kawasaki-shi (JP)

(72) Inventor: Hideki Kubo, Fuchu (JP)

(73) Assignees: KABUSHIKI KAISHA TOSHIBA, Minato-ku (JP); TOSHIBA SOLUTIONS CORPORATION, Kawasaki-shi (JP)

( * ) Notice: Subject to any disclaimer, the term of this patent is extended or adjusted under 35 U.S.C. 154(b) by 2 days.

(21) Appl. No.: 14/469,641

(22) Filed: Aug. 27, 2014

(65) Prior Publication Data

US 2014/0365048 A1 Dec. 11, 2014

Related U.S. Application Data

(63) Continuation of application No. PCT/JP2012/005936, filed on Sep. 18, 2012.

(51) Int. Cl.
*G05D 1/00* (2006.01)
*G05D 3/00* (2006.01)
(Continued)

(52) U.S. Cl.
CPC ..... *B61L 99/00* (2013.01); *B61L 27/0016* (2013.01)

(58) Field of Classification Search
None
See application file for complete search history.

(56) References Cited

U.S. PATENT DOCUMENTS 7,428,452 B2 * 9/2008 Howlett ..... B61L 27/0016 246/2 R
2004/0133315 A1 * 7/2004 Kumar ..... B61L 27/0027 700/302

(Continued)

FOREIGN PATENT DOCUMENTS

EP 2 409 892 A1 1/2012
JP 3544328 B2 7/2004

OTHER PUBLICATIONS

Extended European Search Repot issued Jul. 1, 2016 in Patent Application No. 12884869.4.

*Primary Examiner* — Yonel Beaulieu
*Assistant Examiner* — Lail Kleinman
(74) *Attorney, Agent, or Firm* — Oblon, McClelland, Maier & Neustadt, L.L.P.

(57) ABSTRACT

A diagram creating device has a database and a processing device. The processing device includes a unit which displays names of track sections, names of stations in the track sections, and station line which displays the distances from each station, in parallel to the time axis in the diagram, a unit which displays junction buttons associated with other track sections, near the station line associated with the junction stations belonging to the other track sections in the diagram, and a unit which, when the junction button is pushed, reads the station order data and the junction data based on the track section code of the junction destination, switches part of the station line related to the track section displayed in the diagram for a junction station as a junction point, to the station line subsequent to the junction station belonging to the another track section, and displays the station line.

12 Claims, 13 Drawing Sheets

(51) Int. Cl.

| | |
|---|---|
| ***G06F 7/00*** | (2006.01) |
| ***G06F 17/00*** | (2006.01) |
| ***B61L 99/00*** | (2006.01) |
| ***B61L 27/00*** | (2006.01) |

(56) References Cited

U.S. PATENT DOCUMENTS

2005/0234757 A1* 10/2005 Matheson ..... B61L 27/0016
705/7.37
2011/0184917 A1* 7/2011 Sakikawa ..... B61L 27/0027
707/679

* cited by examiner

DIAGRAM CREATING DEVICE, DIAGRAM CREATING METHOD, AND DIAGRAM DISPLAY PROGRAM

CROSS-REFERENCE TO RELATED APPLICATIONS

A related application of this application is Japanese Patent Application No. 2011-065749 filed on Mar. 24, 2011. This application is a continuation application of International Application No. PCT/JP2012/005936, filed Sep. 18, 2012. The entire contents of each application are incorporated herein by reference.

FIELD

The present embodiment relates to a diagram creating device, a diagram creating method and a diagram display program.

BACKGROUND

Generally, a railroad operating company manages train operations by inputting data such as departure times of trains at each station and distances (kilometers) between neighboring stations on a diagram creating device, and creating diagram data, and then displaying this diagram data on a screen as an operation diagram (referred to as a "diagram" below.). For example, the diagram adopts a kilometer from a departure station (reference station) for a vertical axis and a time for a horizontal axis, and is expressed as a graph in which a traveling station name is arranged on the vertical axis taking an inter-station distance into account.

Further, one train is expressed by one line (diagram line) on the diagram. If a departure station of an outbound train is arranged at the top and coordinates axes are arranged such that the kilometer increases downward and the time increases rightward based on the departure station as the origin, while the outbound train draws a line going downward to the right, an inbound train draws a polygonal line going upward to the right. An inclination of a polygonal line represents a speed of a train. When the speed of a train is faster, the inclination of the line is greater. A horizontal line (inclination 0) indicates that the train stops.

Further, when an operation diagram in a railroad network having track sections including multiple junctions is created, a device to draw junction destination track sections in one screen is made.

The following literature relates to the above technique, the entire content of which are incorporated herein by reference.

CITATION LIST

Patent Literature

Patent Literature 1: Japanese Patent No. 3544328

However, the above diagram notating method is unique to each railroad operating company. Hence, when an operation diagram of a railroad having track sections including multiple junctions, a line drawing operation is performed by not only simply connecting lines but also skipping certain sections, and so on, and therefore it becomes complicated.

Further, when an inter-connection with a train line of other company is realized, consideration on the inter-connection to a new track section needs to be started. However, the above-complicated notating method requires an overall review of a diagram arrangement. This is because the diagram depicting method using paper has been taken over. Even in a computerized diagram system, a new diagram notating/creating method has not been invented.

Further, using a general diagram notating/creating method, creating diagrams is significantly difficult when oversea railroad situations are taken into account. For example, in railroad management in Europe, management of a lower portion (infrastructure) and an organization performing an upper portion (operation and management) are separated, and accounting of the lower portion and accounting of the upper portion are made independent. In the case of Germany in particular, not only the upper portion and the lower portion are separated, but also an open access is introduced and there is even a plurality of upper organizations. The situation is that this mechanism allows an entry of a new operating company and free use of tracks. Further, unlike mass transportation between metropolitan areas in Japan, railroads in Europe also face higher needs for operating trains by freely selecting routes of tracks laid like a mesh for the purpose of transportation between regional hubs. Hence, a diagram system is demanded to effectively utilize one resource of tracks between a plurality of operation companies, and simplify selection and management of operation routes which tend to be complicated. However, the conventional diagram notating/creating method targets at repeated travels on determined train lines as in Japan and therefore the system is not suitable.

DETAILED DESCRIPTION

A diagram creating device according to an embodiment has a database, a processing device and a display device.

The database includes a track section master which stores names of a plurality of track sections in a railroad network including the plurality of track sections, and track section codes for identifying the names as track section data, a station order master which stores a relationship between a station order code which, together with the track section codes, indicates an order from a reference station in the same track section, station names and kilometers from the reference station as train order data, and a junction master which stores a relationship between the track section codes related to a junction station belonging to a plurality of track sections, the station order code and a junction destination track section code as junction data.

The processing device reads track section data, the station order data and the junction data from the database, and creates a diagram which displays a station line and a diagram line associated with the station name, on a two-dimensional plane formed by a time axis and a distance axis. The display device displays the diagram created by the processing device.

The processing device includes a unit which displays names of the track sections, the station names of each station included in the track sections, and the station line which displays the distances of each station from a reference point of each station, in parallel to the time axis in the diagram, a unit which displays junction buttons associated with other track sections of junction destinations, near the station line associated with the junction stations of each station belonging to the other track sections in the diagram, and a unit which, when the junction button is pushed, reads the station order data and the junction data based on the track section code of the junction destination, switches part of the station line related to the track section displayed in the diagram, to the station line subsequent to the junction station belonging to the another track section with the junction station as a starting point, and displays the station line.

The diagram creating device according to an embodiment displays a highly visible and operable diagram, and makes it easy to create operation diagrams in a railroad network including multiple junctions.

Hereinafter, the present embodiment will be described in detail with reference to the drawings.

Figure 1:
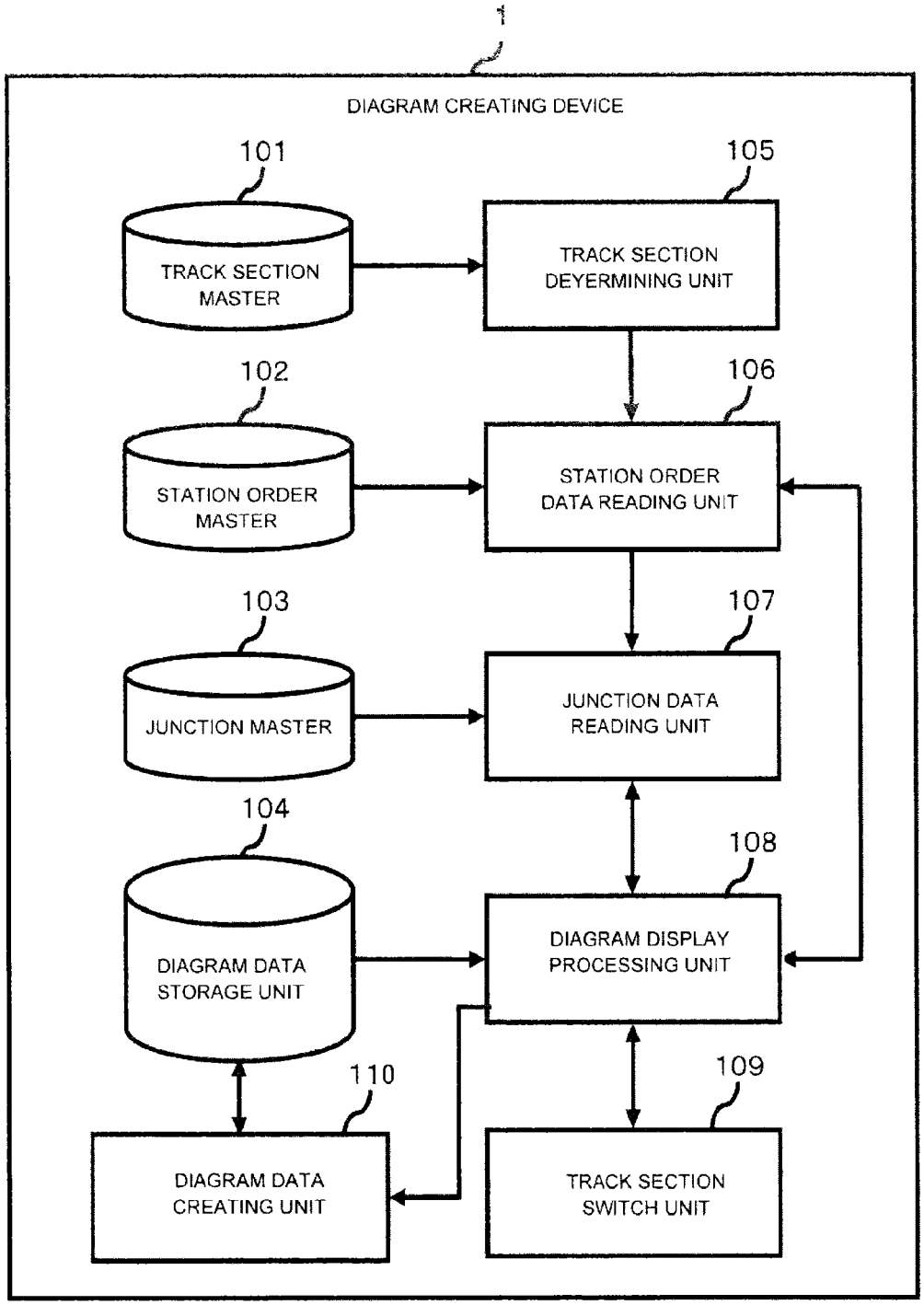
FIG. 1 A block diagram illustrating an example of an entire configuration of a diagram creating device according to an embodiment of the present invention.

FIG. 1 is a block diagram illustrating an example of an entire configuration of a diagram creating device 1 according to the embodiment. As illustrated in FIG. 1, the diagram creating device 1 is a computer which has a track section master 101, a station order master 102, a junction master 103, a diagram data storage unit 104, a track section determining unit 105, a station order data reading unit 106, a junction data reading unit 107, a diagram display processing unit 108, a track section switch unit 109 and a diagram data creating unit 110.

The track section master 101 is a table which stores a relationship between names (train line names) of a plurality of track sections in a railroad network including the plurality of track sections, and track section codes for identifying the names as track section data. Table 1 illustrates a specific example of the track section master 101.

TABLE 1

| Tract section code | name of track section (name of line) |
|---|---|
| 1 | line α |
| 2 | line β |
| 3 | line γ |
| . | . |
| . | . |
| . | . |

The station order master 102 is a table which stores a relationship between track section codes, station order codes indicating orders from a reference station in the same track section, station names and kilometers from the reference station (cumulative distances from a station code 1 or a given reference) as station order data. Table 2 illustrates a specific example of the station order master 102, and illustrates that station order codes are allocated in ascending order from a departure station per track section.

TABLE 2

| Trac section code | Station order code | Station name | Kilometers |
|---|---|---|---|
| 1 | 1 | Station α | 0 |
| 1 | 3 | Station A | 11.5 |
| 1 | 5 | Station B | 32.1 |
| 1 | 7 | Station C | 45.3 |
| . | . | . | . |
| . | . | . | . |
| . | . | . | . |
| 2 | 1 | Station X | 0 |
| 2 | 3 | Station B | 12.5 |
| 2 | 5 | Station Y | 40.3 |
| . | . | . | . |
| . | . | . | . |
| . | . | . | . |
| 3 | 1 | Station B | 0 |
| 3 | 3 | Station Z | 15.6 |
| . | . | . | . |
| . | . | . | . |
| . | . | . | . |

The junction master 103 is a table which stores a relationship between track section codes related to a junction station belonging to a plurality of track sections, station order codes and junction destination track section codes as junction data. Table 3 illustrates a specific example of the junction master 103.

TABLE 3

| Track section code | Station order code | Display order from station line to another track section | Junction destination track section code | Junction destination tracsection direction |
|---|---|---|---|---|
| 1 | 5 | −1 | 2 | −1 |
| 1 | 5 | 1 | 2 | 1 |
| 1 | 5 | 2 | 3 | 1 |
| . | . | . | . | . |

TABLE 3-continued

| Track section code | Station order code | Display order from station line to another track section | Junction destination track section code | Junction destination tracsection direction |
|---|---|---|---|---|
| . | . | . | . | . |
| . | . | . | . | . |

Here, when a display order from a station line to another track section take positive values, the display order shows that it is arranged in a station order code ascending order side (to a lower side of a diagram). When the display order takes a negative value, the display order shows that it is arranged in a station order code descending order side (to an upper side of the diagram). Further, when a junction destination track section direction is 1, the direction shows that it branches toward a station in the station order code ascending order direction. When the junction destination track section direction is −1, the direction shows that it branches toward a station in the station order code descending order direction.

The track section determining unit 105 is a program which determines a track section code related to a target track section whose diagram indicating a relationship between the kilometer and a time is displayed and created referring to the track section master 101. In addition, a method of determining a track section code includes a method of reading data from the track section master 101 and having a user select data from a list displayed on a screen, or a method of directly inputting a track section code.

The station order data reading unit 106 is a program which reads station order data from the station order master 102 using as a key a track section code determined by the track section determining unit 105.

The junction data reading unit 107 is a program which reads the junction data from the junction master 103 using as keys a track section code and a station order code included in station order data read by the station order data reading unit 106.

The diagram display processing unit 108 is a program which draws a station line representing a kilometer of a station included in a target track section based on station order data and displays the station name in association with the station line, and displays a diagram creation screen including a diagram with junction buttons associated with junction destination track section codes and junction track section directions, near the station line related to the junction station in the diagram based on junction data.

Further, the diagram display processing unit 108 creates and displays a diagram by determining an arrangement of junction buttons and station order codes associated with the junction buttons based on an arrangement order of the junction buttons with respect to a station line of a junction station included in junction data (a display order from a station line to another track section) and a direction flag (junction line track section direction) from the junction station to a neighboring station in another track section.

The track section switch unit 109 is a program which, when the junction button is pushed on the diagram creation screen, switches part of a station line related to the target track section displayed in the diagram, to the station line subsequent to a junction station belonging to another track section with the junction station as a starting point based on a junction destination track section code, and displays the station line. More specifically, the track section switch unit 109 switches a track section by outputting to the diagram display processing unit 108 junction destination track section codes, station order codes and junction destination track section directions associated with the junction buttons upon creation of the diagram, and causing the diagram display processing unit 108 to re-read master data.

The diagram data creating unit 110 is a program which analyzes a coordinate of a diagram line drawn as a continuous line in the diagram on the diagram creation screen, and creates diagram data indicating a relationship between a track section code related to a track section in which a train travels, a departure station, an arrival station, a departure time and an arrival time.

Further, when a diagram line based on the created diagram data is changed on the diagram creation screen, the diagram data creating unit 110 creates new diagram data based on the changed diagram line, and updates the diagram data storage unit 104.

Figure 2:
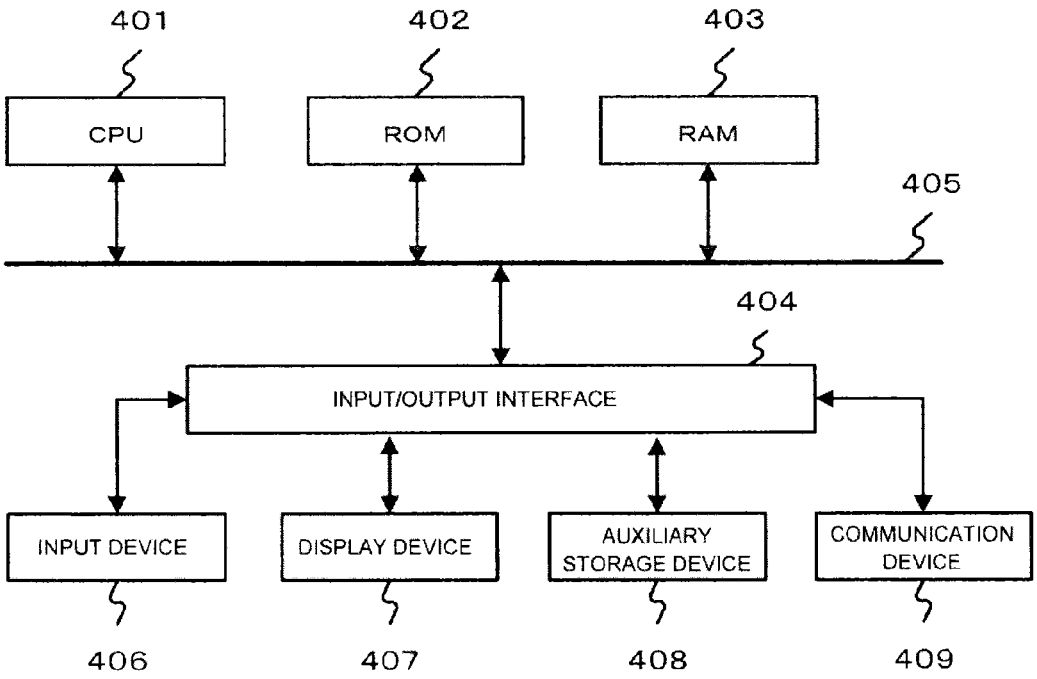
FIG. 2 A view illustrating an example of a hardware configuration of the diagram creating device illustrated in FIG. 1.

FIG. 2 is a view illustrating an example of a hardware configuration or a computer applied to the diagram creating device illustrated in FIG. 1. As illustrated in FIG. 2, the diagram creating device has a CPU (Central Processing Unit) 401, a ROM (Read Only Memory) 402, a RAM (Random Access Memory) 403, an input/output interface 404, a system bus 405, an input device 406, a display device 407, an auxiliary storage device 408 and a communication device 409.

The CPU 401 is a processing device which executes various computation processing using programs and data stored in the ROM 402 and the RAM 403. The ROM 402 is a read-only storage device which stores basic programs and environment files for causing the computer to function. The RAM 103 is a storage device which stores the programs to be executed by the CPU 401 and data required to execute each program, and enables data to be read and written at a high speed. The input/output interface 104 is a device and a program that interface connection between various types of hardware and the system bus 405. The system bus 405 is an information transmission path shared by the CPU 401, the ROM 402, the RAM 403 and the input/output interface 404.

Further, hardware, such as the input device 406, the display device 407, the auxiliary storage device 408, the communication device 409, are connected with the input/output interface 404. The input device 406 is a device that processes inputs from a user, and is, for example, a keyboard or a mouse. The display device 407 is a device that displays a computation result or a creation screen for the user, and is, for example, a CRT, a liquid crystal display or a plasma display. The auxiliary storage device 408 is a large volume storage device that accumulates a traveling record data creating program and data, and is, for example, a hard disk device.

Figure 3:
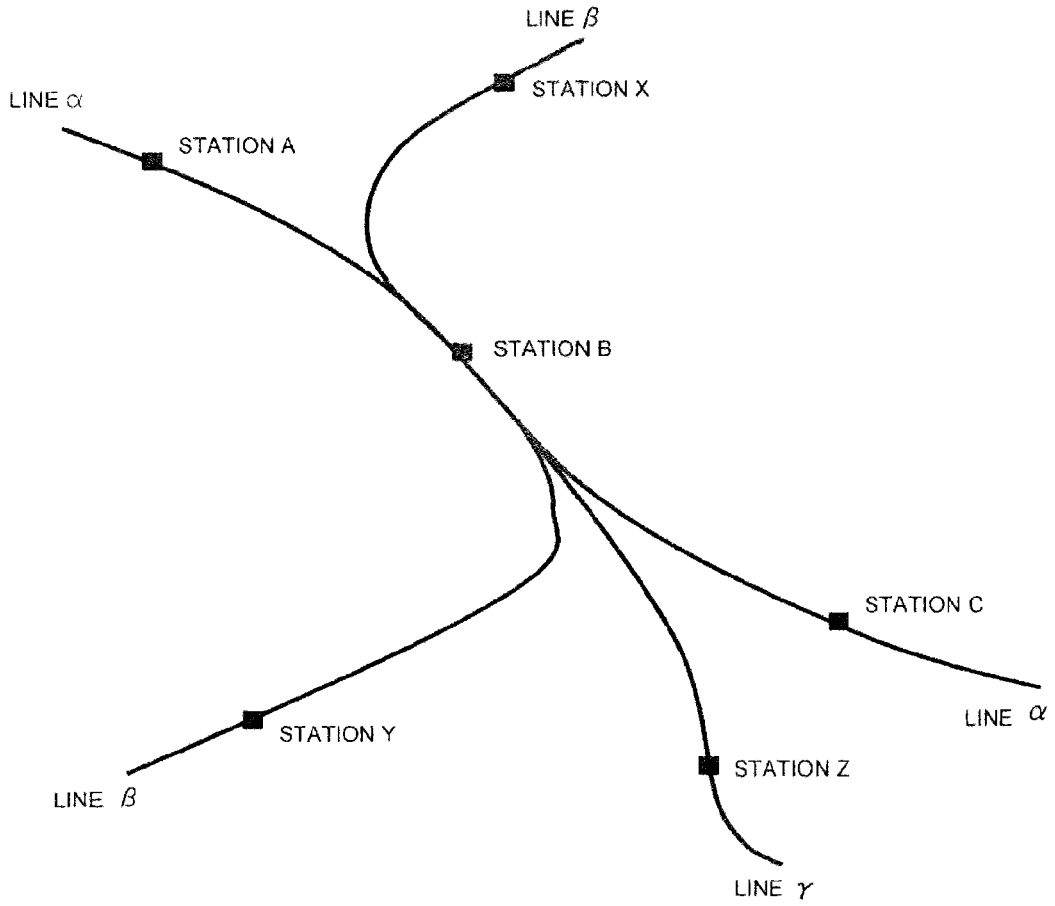
FIG. 3 A train line map illustrating a railroad network which is a diagram data creation target in the diagram creating device illustrated in FIG. 1.
Figure 4:
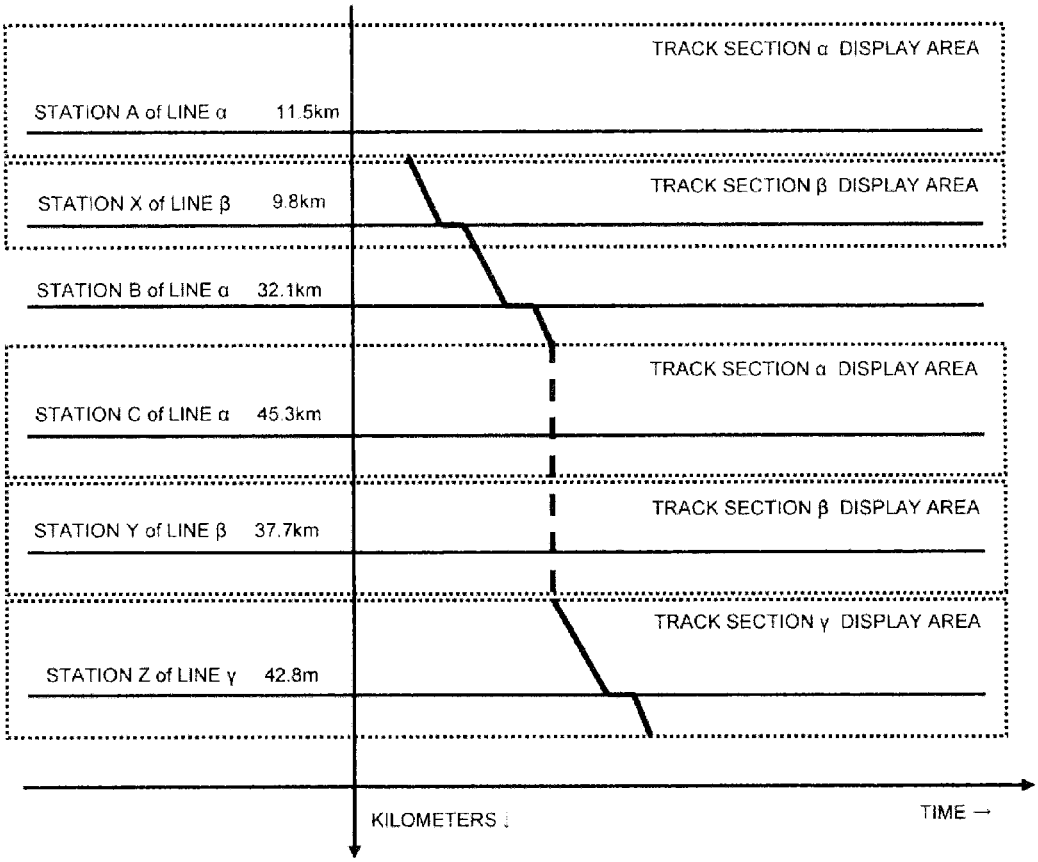
FIG. 4 A view illustrating a specific example of a diagram created and displayed by a conventional diagram creating device for the train line illustrated in FIG. 3.

FIG. 3 is a train line map illustrating a railroad network which is a diagram data creation target in the diagram creating device illustrated in FIG. 1. In this railroad network, three train lines of a track section α, a track section β and a track section γ branch from a station B. Further, FIG. 4 is a view illustrating a specific example of a diagram created and displayed by a conventional diagram creating device for the train lines illustrated in FIG. 3. As illustrated in FIG. 4, different track sections are combined and notated in one diagram in many cases. This is a device to notate junction track sections in one diagram. However, when diagram lines are drawn (trains are drawn one by one on a diagram) by this diagram expression on a computer, drawing junction portions and performing operations both become complicated.

Further, being influenced by an actual situation of each train line of a railroad company, it is very difficult to realize a uniform system that is regardless of the railroad companies.

When, for example, there is a train going from a station X of the track section β to a station Z of the track section γ via the station B, a diagram line is as illustrated by the diagram in FIG. 4. The diagram line needs to be drawn by skipping the track section α and the track section β (a portion connected by a dotted line) below the station B. Further, link information needs to be additionally input to connect the diagram line by the dotted line.

By contrast with this, the diagram creating device 1 according to the embodiment of the present invention can draw a diagram line as a continuous line over a plurality of track sections. Hereinafter, diagram creation processing and track section switch processing of the diagram creating device 1 will be described in detail.

Figure 5:
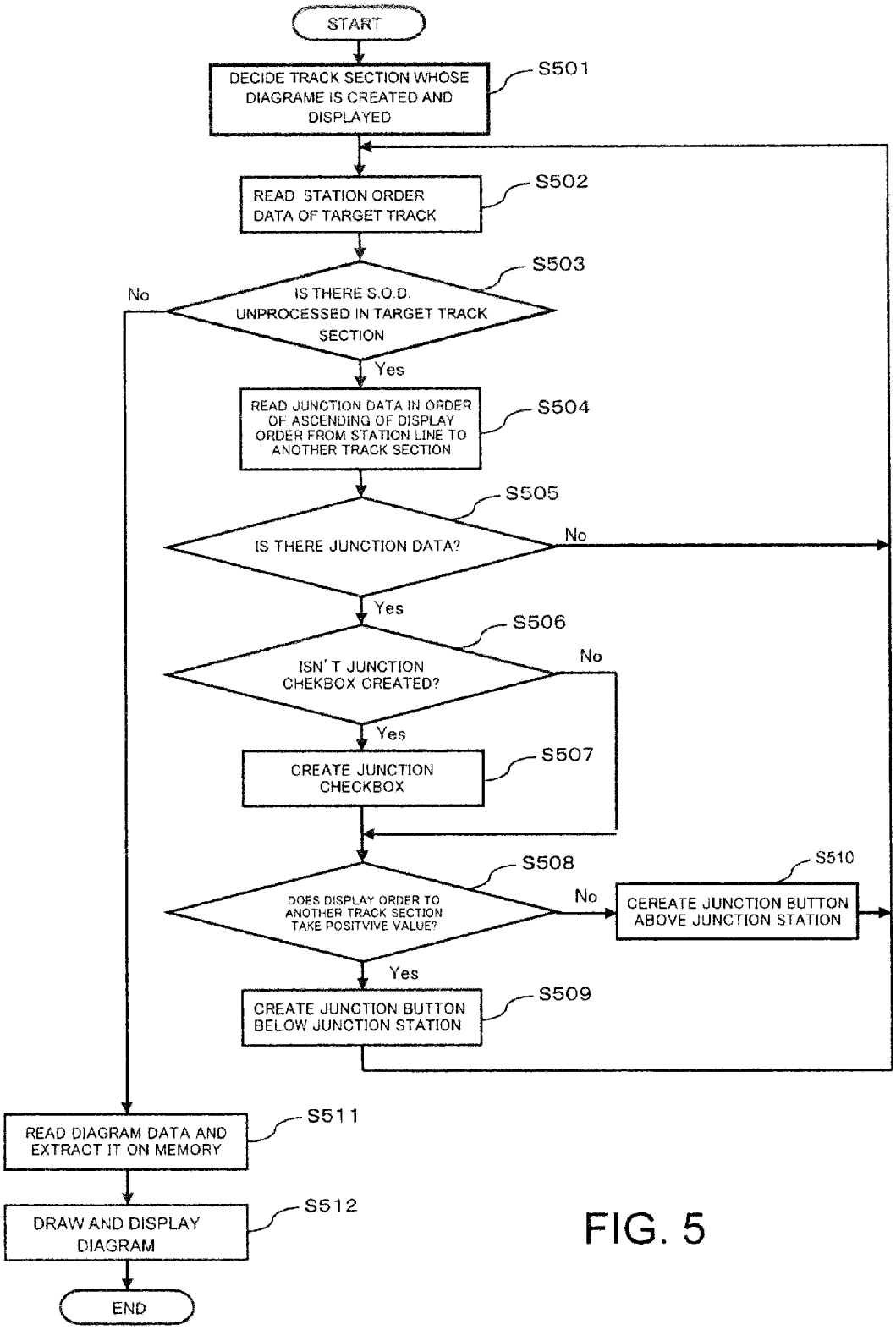
FIG. 5 A flowchart illustrating a specific example of diagram creation processing of the diagram creating device illustrated in FIG. 1.

FIG. 5 is a flowchart illustrating a specific example of diagram creation processing of the diagram creating device illustrated in FIG. 1.

In S501, the track section determining unit 105 determines a track section code related to a target track section whose diagram indicating a relationship between the kilometer and a time is displayed and created referring to the track section master 101.

In S502, the station order data reading unit 106 reads station order data from the station order master 102 using as a key a track section code determined by the track section determining unit 105.

In S503, the station order data reading unit 106 determines whether or not there is unprocessed station order data of a target track section. In this regard, when the station order data reading unit 106 determines that there is unprocessed station order data (S503: Yes), the step proceeds to S504. By contrast with this, when the station order data reading unit 106 determines that there is not unprocessed station order data (S503: No), the step proceeds to S511.

In S504, the junction data reading unit 107 reads junction data from the junction master 103 using as keys a track section code and a station order code included in station order data read by the station order data reading unit 106. In this case, the junction data reading unit 107 reads junction data in order of a small display instruction order (a display order from a station line to another track section) of the junction master 103 corresponding to the station order code.

In S505, the diagram display processing unit 108 determines whether or not there is junction data. In this regard, when the diagram display processing unit 108 determines that there is junction data (S505: Yes), the step proceeds to S506. By contrast with this, when the diagram display processing unit 108 determines that there is not junction data (S505: No), the step returns to S502.

In S506, the diagram display processing unit 108 determines whether or not a junction checkbox is not created. In this regard, when determining that the junction checkbox is not created (S506: Yes), the diagram display processing unit 108 creates the junction checkbox (S507). By contrast with this, when determining that the junction checkbox is created (S506: No), the step proceeds to S508.

In S508, the diagram display processing unit 108 determines whether or not a display order to another track section takes a positive value. In this regard, when the diagram display processing unit 108 determines that the display order takes a positive value (S508: Yes), the step proceeds to S509. By contrast with this, when the diagram display processing unit 108 determines that the display order takes a negative value (S508: No), the step proceeds to S510.

In S509, the diagram display processing unit 108 creates junction buttons below the junction station.

In S510, the diagram display processing unit 108 creates junction buttons above the junction station.

In S511, the diagram display processing unit 108 reads registered diagram data from the diagram data storage unit 104, and expands the diagram data onto the memory.

In S512, the diagram display processing unit 108 draws and displays a diagram.

Figure 6:
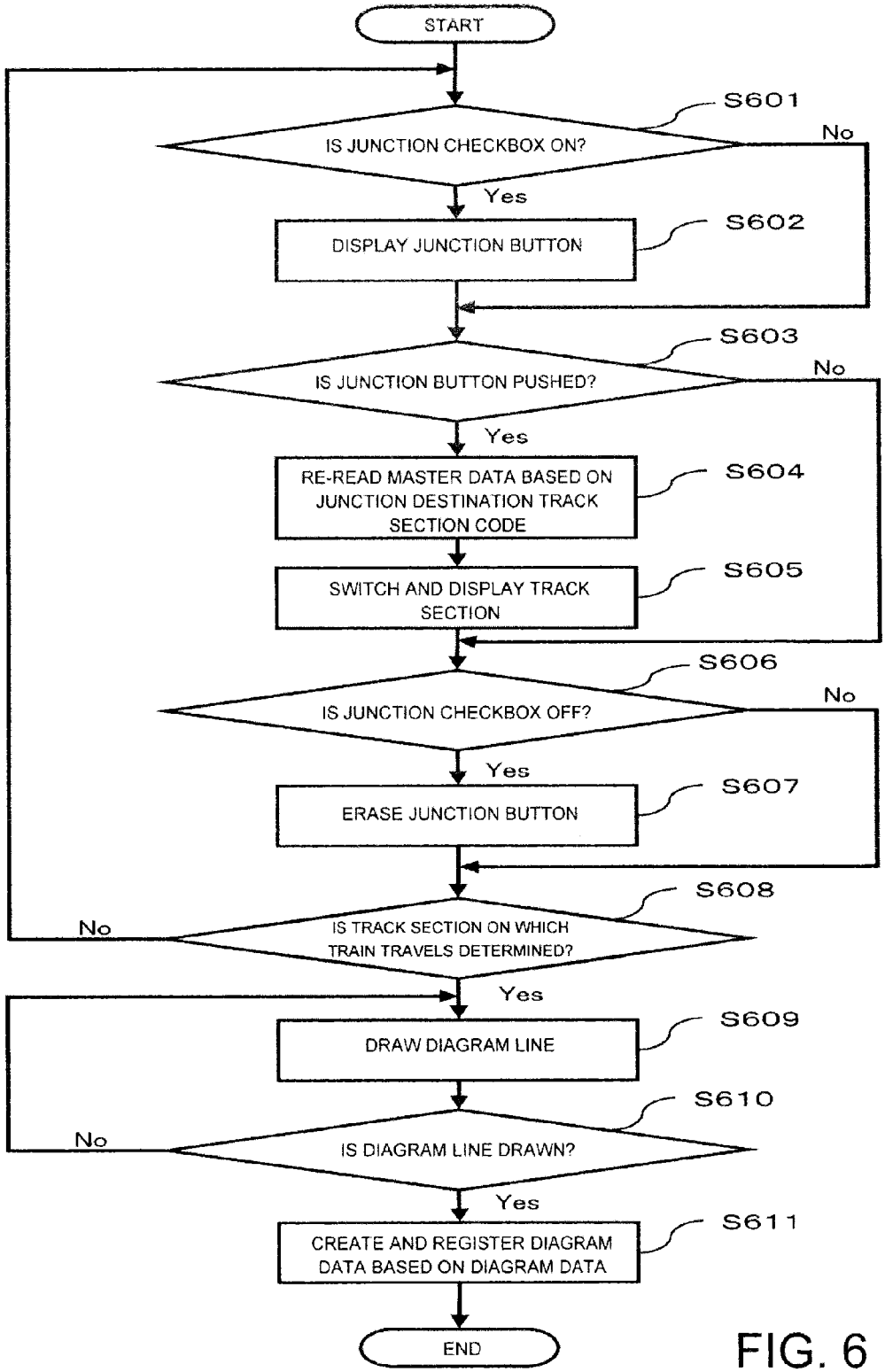
FIG. 6 A flowchart illustrating a specific example of track section switch processing of the diagram creating device illustrated in FIG. 1.
Figure 7:
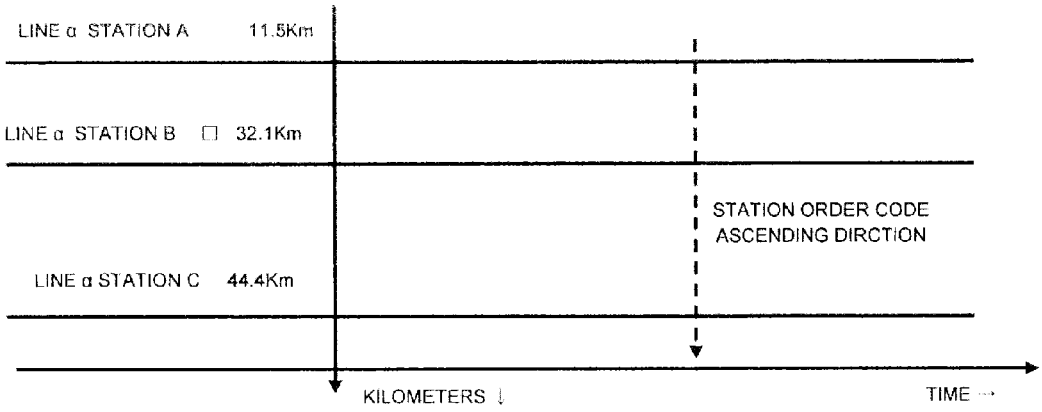
FIG. 7 A view for explaining a method of the track section switch processing of the diagram creating device illustrated in FIG. 1.

FIG. 6 is a flowchart illustrating a specific example of track section switch processing of the diagram creating device 1 illustrated in FIG. 1. Further, FIGS. 7 to 12 are views illustrating specific examples of the track section switch processing.

In S601, the diagram display processing unit 108 determines whether or not the junction checkbox displayed on the diagram creation screen is ON. ON/OFF of the junction checkbox is a switch which, when there is a junction around a station line of a junction station, determines whether or not to display junction buttons. In this regard, when the diagram display processing unit 108 determines that the junction checkbox is ON (S601: Yes), the step proceeds to S602. By contrast with this, when the diagram display processing unit 108 determines that the junction checkbox is OFF (S601: No), the step proceeds to S603.

Figure 8:
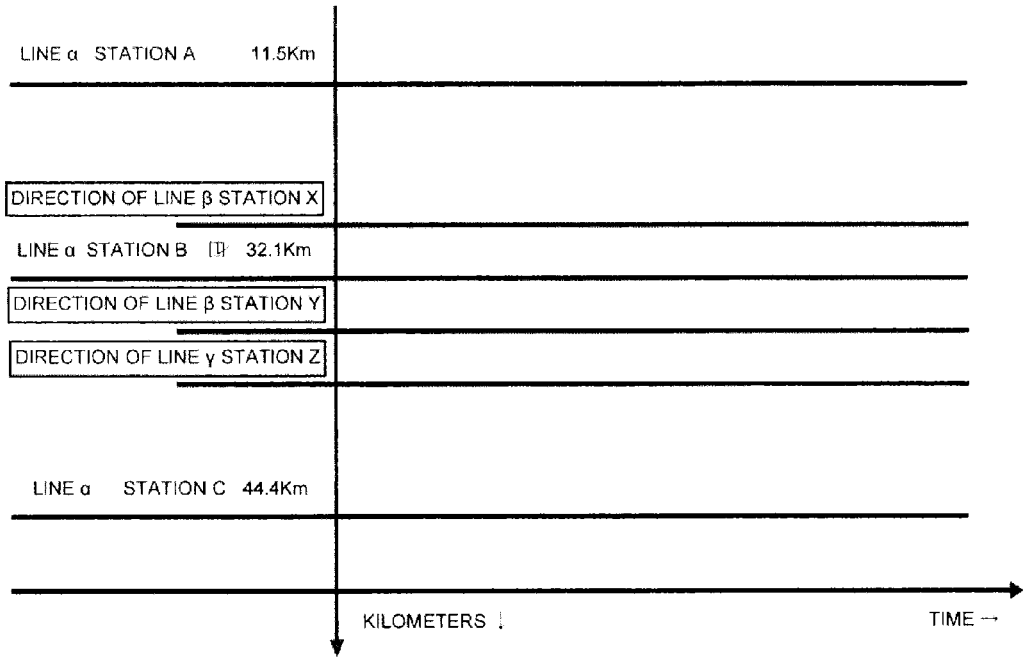
FIG. 8 A view for explaining the method of the track section switch processing of the diagram creating device illustrated in FIG. 1.

In S602, the diagram display processing unit 108 displays the junction button near the station line of the junction station on the diagram creation screen. Provided that the junction checkbox is an OFF state first, a diagram drawing region when the track section α is displayed is in a state illustrated in FIG. 7. Further, when the junction checkbox displayed between the station name and the kilometer is ON, the junction buttons are displayed in the surrounding of the station B of the α line in which there are junctions as illustrated in FIG. 8. In this regard, the junction buttons are displayed based on the junction master 103 displayed in above table 3. When the display order to another track section takes a negative value, the junction buttons are arranged on a station code descending order side (the upper side of the diagram). When the display order to another track section takes a positive value, the junction buttons are arranged on a station code ascending order (a lower side of the diagram).

In S603, the track section switch unit 109 determines whether or not the junction button is pushed on the diagram creation screen. In this regard, when the track section switch unit 109 determines that the junction button is pushed (S603: Yes), the step proceeds to S604. By contrast with this, when the track section switch unit 109 determines that the junction button is not pushed (S601: No), the step proceeds to S605.

In S604, the track section switch unit 109 outputs the junction destination track section code, the station order code and the junction destination track section direction associated with the pushed junction button, to the diagram display processing unit 108. Subsequently, the diagram display processing unit 108 reads master data from the station order master 102 and the junction master 103 using as keys the station order code and the junction destination track section code. The processing of reading the master data is the same as the flowchart in above FIG. 5. However, station order master data of only from the junction station to the junction destination track section direction needs to be re-read from the station order master 102.

In S605, the diagram display processing unit 108 switches part of a diagram display region related to the target track section in the diagram based on the junction destination track section code, to a diagram display region related to another track section with the junction station as a starting point, and displays the diagram display region.

Figure 9:
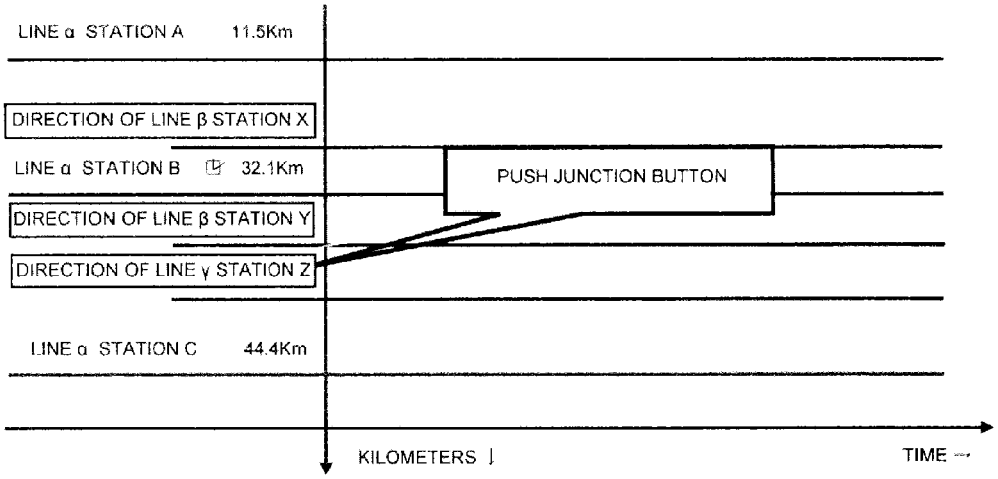
FIG. 9 A view for explaining the method of the track section switch processing of the diagram creating device illustrated in FIG. 1.
Figure 10:
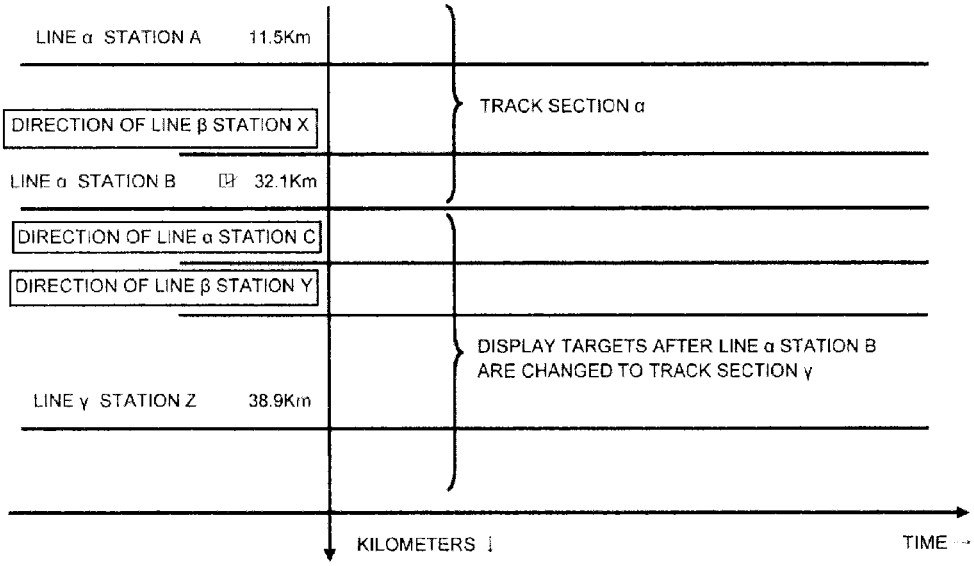
FIG. 10 A view for explaining the method of the track section switch processing of the diagram creating device illustrated in FIG. 1.
Figure 11:
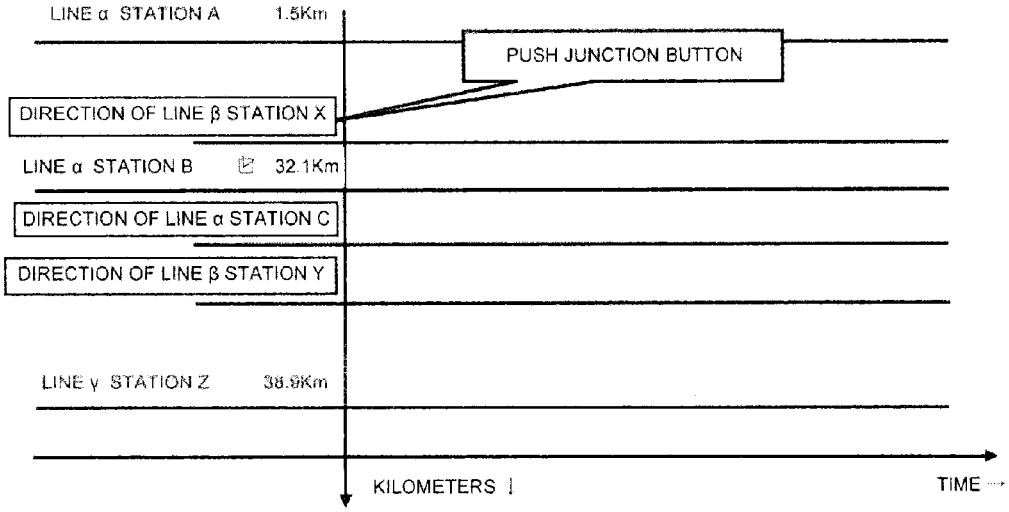
FIG. 11 A view for explaining the method of the track section switch processing of the diagram creating device illustrated in FIG. 1.
Figure 12:
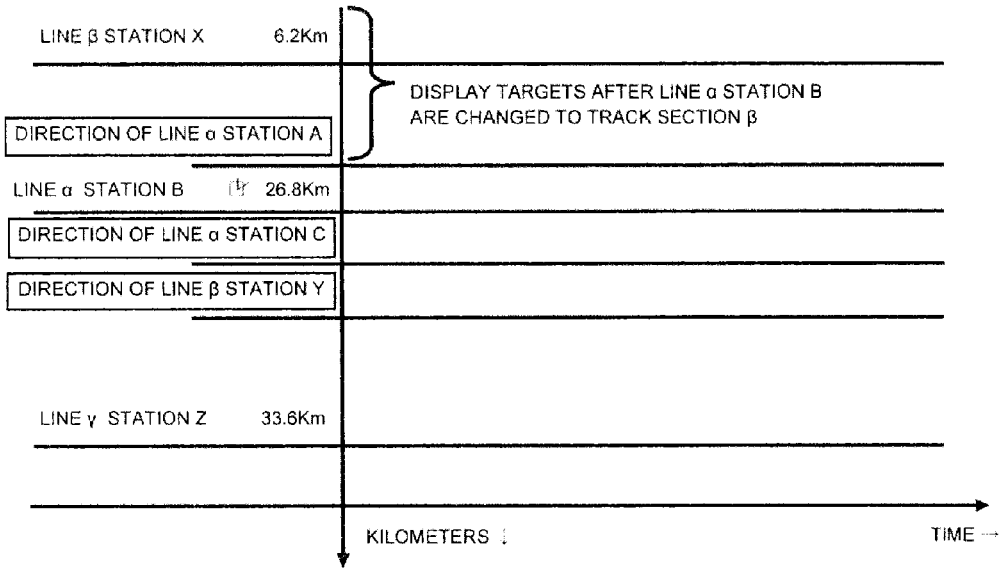
FIG. 12 A view for explaining the method of the track section switch processing of the diagram creating device illustrated in FIG. 1.

As illustrated in, for example, FIG. 9, in a state where the track section α is displayed, three junction buttons of the station B appear. Further, when the junction button of "for station Z of track section γ" on the station order code ascending order side (the lower side of the screen) is clicked, the station order code ascending order side (screen lower side) of the station B is switched to the track section γ as illustrated in FIG. 10. Further, the junction button of the line γ is re-created by re-reading the junction master 103 as the station B of the track section γ. Further, when the junction button of "for station X of track section β" on the station order code descending order side (the upper side of the screen) is clicked in a state where the three junction buttons of the station B appear as illustrated in FIG. 11, the station order code descending order side (the upper side of the screen) of the station B is switched to the track section β as illustrated in FIG. 12.

In S606, the diagram display processing unit 108 determines whether or not the junction checkbox displayed on the diagram creation screen is OFF. In this regard, when the diagram display processing unit 108 determines that the junction checkbox is OFF, the step proceeds to S607. By contrast with this, when the diagram display processing unit 108 determines that the junction checkbox is ON, the step proceeds to S608.

In S607, the diagram display processing unit 108 switches to non-display the junction button displayed near the station line of the junction station on the diagram creation screen.

In S608, the diagram display processing unit 108 determines whether or not a track section in which a train travels is determined based on whether or not there is a track section switch request. In this regard, when the diagram display processing unit 108 determines that the track section is determined, the step proceeds to S609. By contrast with this, when the diagram display processing unit 108 determines that the track section is not determined, the step returns to S601.

In S609, the diagram display processing unit 108 receives an input of the track section displayed on the diagram from the user, and draws a diagram line.

In S610, the diagram display processing unit 108 determines whether or not drawing the diagram line on the diagram creation screen is finished. The diagram display processing unit 108 makes the determination based on, for example, whether or not a finish button (not illustrated) is pushed. In this regard, when the diagram display processing unit 108 determines that drawing the diagram line is finished, the step proceeds to S611. By contrast with this, when the diagram display processing unit 108 determines that drawing the diagram line is not finished, the step returns to S609.

Figure 13:
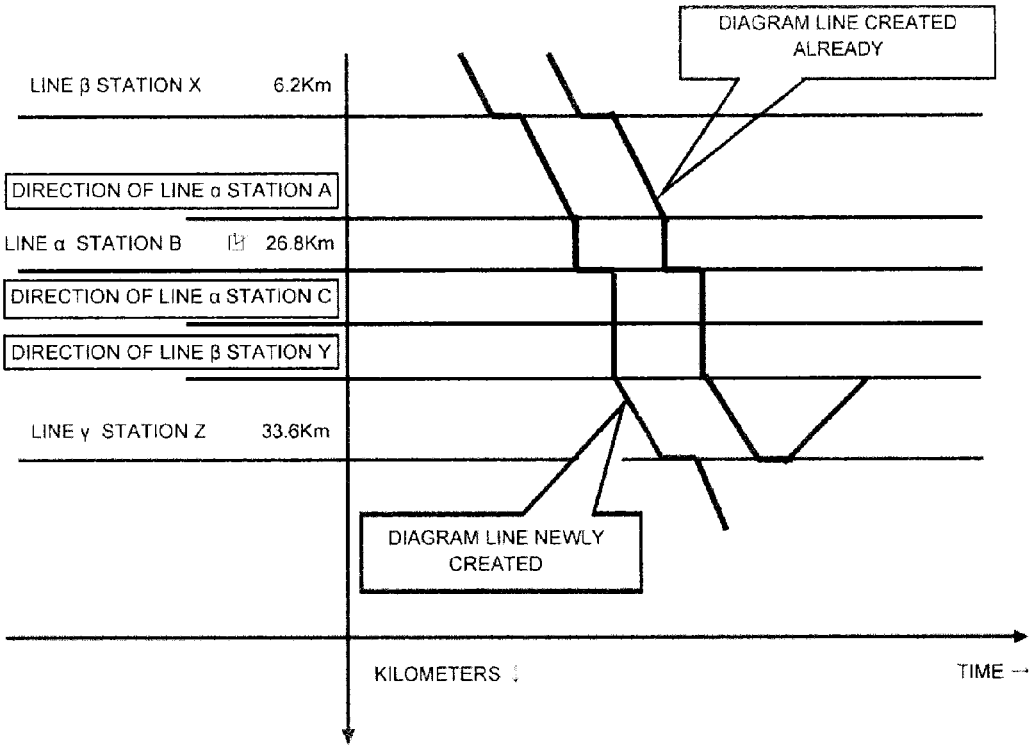
FIG. 13 A view illustrating a specific example of diagram lines drawn on a diagram by the diagram creating device illustrated in FIG. 1.

In S611, the diagram data creating unit 110 analyzes a coordinate of a diagram line drawn as a continuous line in the diagram on the diagram creation screen, creates diagram data indicating a relationship between a track section code related to a track section in which a train travels, a departure station, an arrival station, a departure time and an arrival time, and registers the diagram data in the diagram data storage unit 104. In addition, when a diagram line related to registered diagram data is changed, the diagram data is updated. When, for example, there is a train traveling from the station X of the track section β to the station Z of the track section γ via the station B similar to the case illustrated in FIG. 1, the diagram lines are as in the diagram illustrated in FIG. 13. Consequently, it is possible to realize plain drawing that obscures junctions.

In the diagram creating device 1 according to the present embodiment, by preparing junction buttons (junction track section display buttons) at a station around which there are junction track sections, and pushing the junction button, buttons on which junction track section names are written appear in an inbound direction and an outbound direction of a station display portion. Further, when the button on which the junction track section name is written is pushed, an indication therefrom is switched to a newly selected track section. By using this indication, it is possible to express a diagram like a simple straight train line even when there is a junction, and draw diagram lines on the diagram and perform an operation by a simple operation.

Further, in addition to a train line having junctions and inter-connections, it is also possible to discuss an inter-connection by correcting master data even for a track section which adopts a structure which does not allow an inter-connection but for which an inter-connection is discussed in the future.

Further, it is possible to draw a diagram like one continuous track section around a junction station, and draw a diagram according to a simple and conventional diagram theory of drawing lines between stations. Particularly when a train diagram is created on train lines laid like a mesh, it is possible to display continuous and highly visible diagram lines by switching junctions and expressing the junctions as one train line without losing continuity of lines and making the lines drawn like dotted lines.

Figure 14:
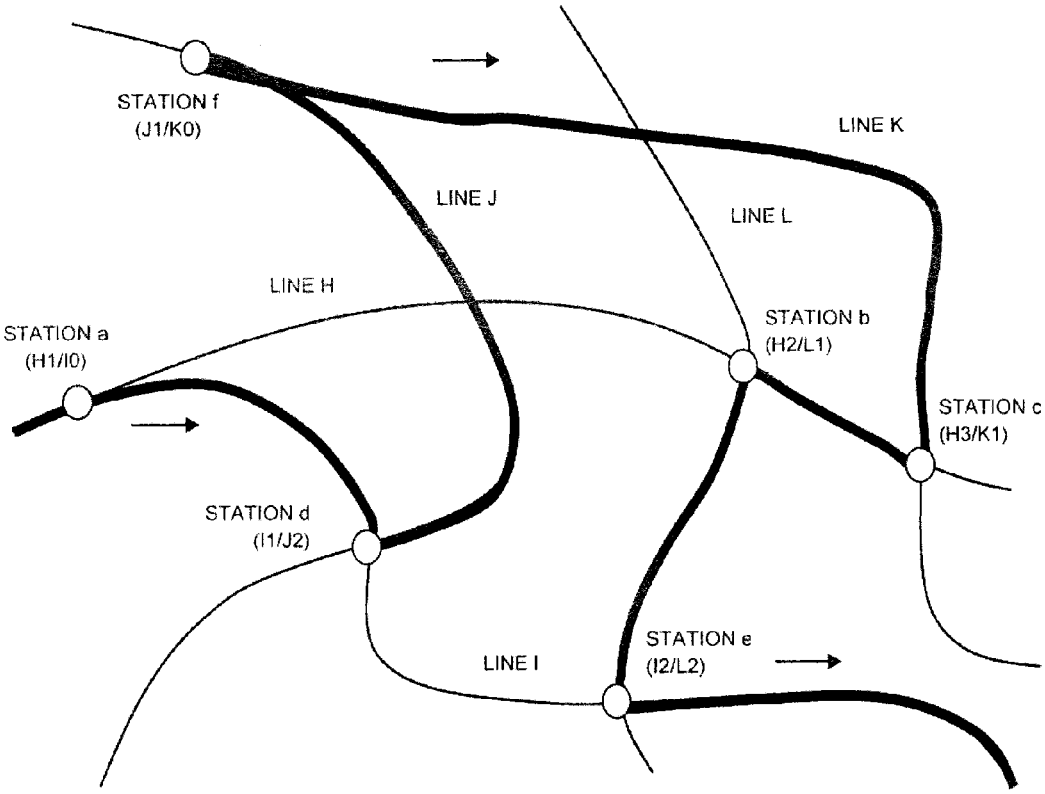
FIG. 14 A train line map illustrating another diagram creation target railroad network of the diagram creating device illustrated in FIG. 1.
Figure 15:
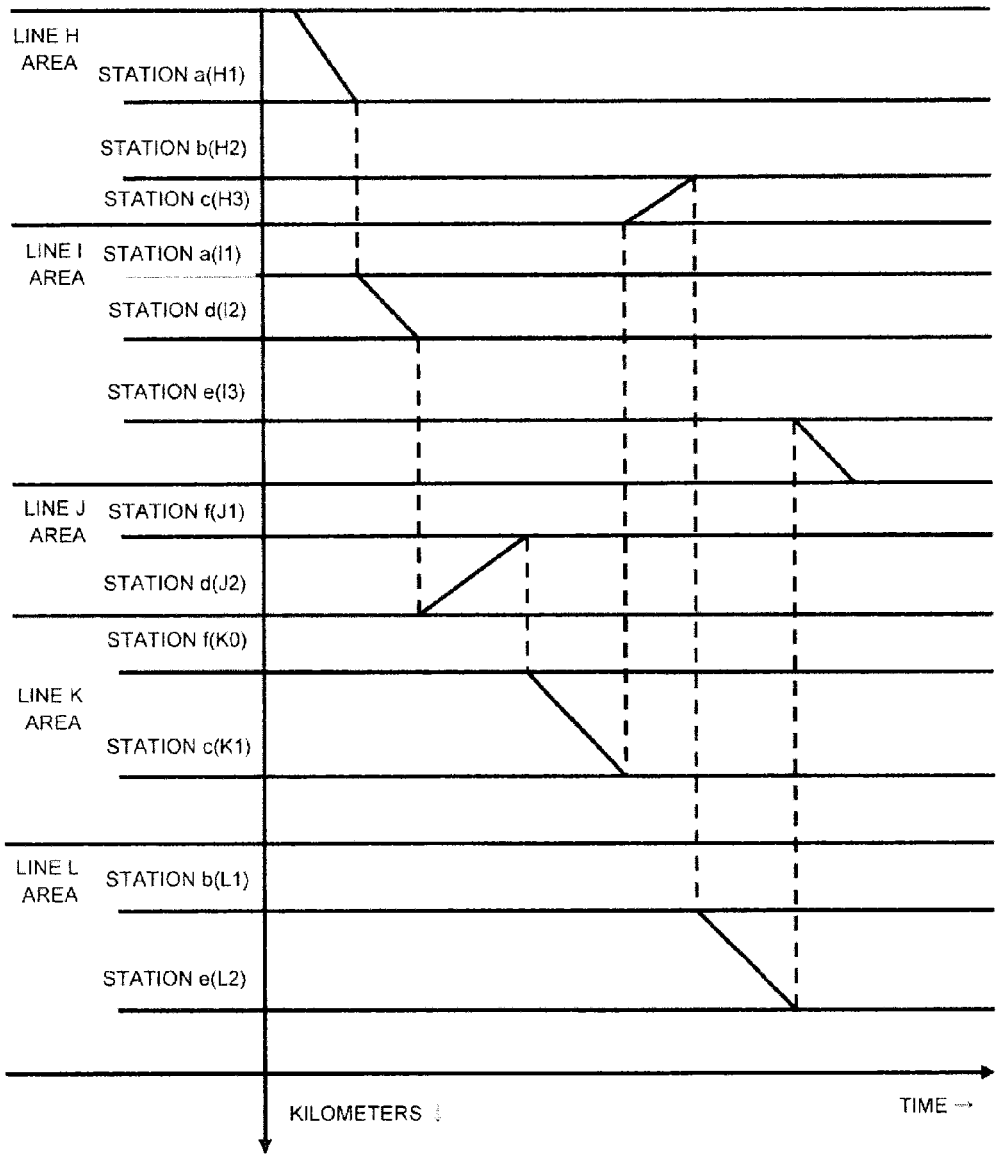
FIG. 15 A view illustrating a specific example of a diagram created and displayed by the conventional diagram creating device for the railroad network illustrated in FIG. 11.

A difference from a conventional diagram line will be described as a supplement below. FIG. 14 is a train line map illustrating a diagram creation target railroad network in the diagram creating device illustrated in FIG. 1. In this case, there are five train lines laid like a mesh. Further, FIG. 15 is a view illustrating a specific example of a diagram displayed by a conventional diagram creating device for the railroad network illustrated in FIG. 14. In this regard, a case will be assumed where a diagram of a train which travels like a bold line in the railroad network as in FIG. 14. According to a conventional Japanese drawing/expressing method, all routes are depicted on the same screen or sheet, or only train lines whose routes are determined and narrowed to some degree are displayed to create a diagram. However, according to this drawing rule, when a train line is freely selected to set a route, a diagram line loses continuity as illustrated in FIG. 15, and the screen has poor visibility and operability.

Figure 16:
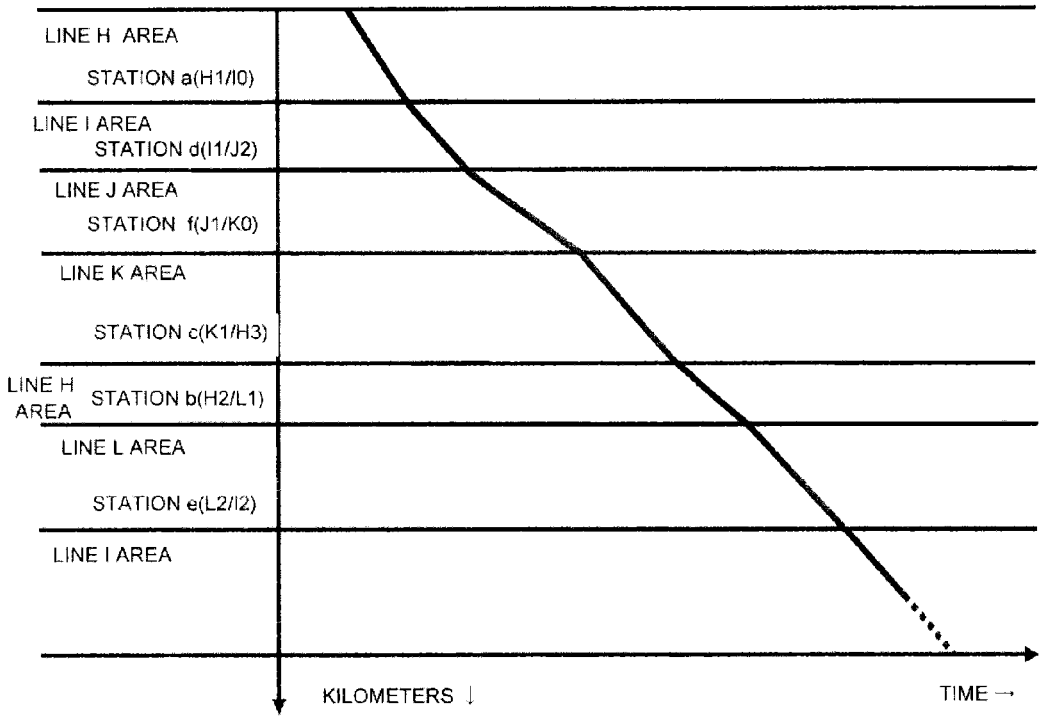
FIG. 16 is a view illustrating a specific example of a diagram created and displayed by the diagram creating device illustrated in FIG. 1 for the railroad network illustrated in FIG. 14.

Further, in contrast, FIG. 16 is a view illustrating a specific example of a diagram displayed by the diagram creating device illustrated in FIG. 1 for the railroad network illustrated in FIG. 14. For example, a line H is displayed in the form of the diagram at first. In this situation, by selecting junction buttons one after another, a diagram including a station order illustrated in FIG. 16 can be readily displayed, even if a complicated route, indicated by bold line including different lines shown in FIG. 14, is required to be displayed in the form of the diagram. Consequently, it is possible to draw diagram lines as highly visible and continuous lines compared to FIG. 15.

Embodiments of the present invention have been described. However, these embodiments are exemplary and are not intended to limit the claims. These new embodiments can be implemented in other various modes and can be variously omitted. replaced or changed as long as the various omissions, replacements and changes do not deviate from the spirit of the invention. These embodiments and modifications thereof are included in the scope and the spirit of the invention, and are included in the range equivalent to the invention recited in the claims.

In addition, the programs for causing processes according to the present embodiment to be executed and the data related to the programs may be provided by computer-readable storage media. For example, these storage media are CD-ROMs (Compact Disk Read Only Memory), floppy disks (FD), CD-Rs (Compact Disk Recordable), and DVDs (Digital Versatile Disk).

Further, the programs for causing the processes according to the present embodiment to be executed and the data related to the programs may be stored in a computer that has downloaded those through a network such as the Internet or the Ethernet and. Furthermore, the programs and the data may be provided on these networks in a state where the program and the data can be downloaded to computers and the like. Still further, the programs for causing the processes according to the present embodiment to be executed and the data related to the programs may be provided in a state where the programs and the data can be downloaded in separate regions on a cloud.

Moreover, the programs for causing the processes according to the present embodiment to be executed and the data related to the programs may be stored in a ROM or a flash memory in a device in advance, and provided.

What is claimed is:

1. A diagram creating device comprising:

a database which includes a track section master which stores names of a plurality of track sections in a railroad network including the plurality of track sections, and track section codes for identifying the names as track section data, a station order master which stores a relationship between a station order code which, together with the track section codes, indicates an order from a reference station in the same track section, station names and kilometers from the reference station as train order data, and a junction master which stores a relationship between the track section codes related to a junction station belonging to the plurality of track sections, the station order code and a junction destination track section code as junction data;

a processing device which reads track section data, the station order data and the junction data from the database, and creates a diagram which displays a station line and a diagram line associated with the station name, on a two-dimensional plane formed by a time axis and a distance axis; and a display device which displays the created diagram, wherein the processing device includes a unit which displays the names of the track sections and the station names of each station included in the track sections, and the station line which displays the distances of each station from a reference point, in parallel to the time axis in the diagram, a unit which displays a junction button associated with another track section of a junction destination, near the station line associated with the junction station of each station belonging to the another track section in the diagram, and a unit which, when the junction button is pushed, reads the station order data and the junction data based on the track section code of the junction destination, switches part of the station line related to the track section displayed in the diagram, to the station line subsequent to the junction station belonging to the another track section with the junction station as a starting point, and displays the station line.

2. A diagram creating device comprising:

a processing device which reads names of a plurality of track sections in a railroad network including the plurality of the track sections and track section codes for identifying the names as track section data, reads a relationship between a station order code which, together with the track section codes, indicates an order from a reference station in the same track section, a station name and a kilometer from the reference station as station order data, and reads a relationship between the station order code and a junction destination track section code as junction data, and creates a diagram which displays a station line and a diagram line associated with the station name on a two-dimensional plane formed by a time axis and a distance axis; and a display device which displays the created diagram, wherein the processing device includes a unit which displays the names of the track sections, the station names of each station included in the track sections, and the station line which displays the distances of each station from a reference point, in parallel to the time axis in the diagram, and a unit which displays a junction button associated with another track section of a junction destination, near the station line associated with the junction station of each station belonging to the another track section in the diagram.

3. A diagram creating device comprising:

a track section master which stores names of a plurality of track sections in a railroad network including the plurality of track sections, and track section codes for identifying the names as track section data, a station order master which stores a relationship between a station order code which, together with the track section codes, indicates an order from a reference station in the same track section, a station name and a kilometer from the reference station as station order data;

a junction master which stores a relationship between the track section codes related to a junction station belonging to the plurality of track sections, the station order code and a junction destination track section code as junction data;

a track section determining unit which determines the track section code related to a target track section whose diagram indicating a relationship between the kilometer and a time is displayed and created referring to the track section master;

a station order data reading unit which reads the station order data from the station order master using as a key the track section code determined;

a junction data reading unit which reads the junction data from the junction master using as keys the track section code and the station order code included in the station order data read;

a diagram display processing unit which draws a station line representing the kilometer of a station included in the target track section based on the station order data and displays the station name in association with the station line, and displays a diagram creation screen including the diagram with a junction button associated with the junction destination track section code;

a track section switch unit which, when the junction button is pushed, switches part of the station line related to the target track section in the diagram, to the station line subsequent to the junction station belonging to the another track section with the junction station as a starting point based on the junction destination track section code, and displays the station line; and a diagram data creating unit which analyzes a coordinate of a diagram line drawn as a continuous line in the diagram on the diagram creation screen, and creates diagram data indicating a relationship between the track section code related to a track section in which the train travels, a departure station, an arrival station, a departure time and an arrival time.

4. The diagram creating device according to claim 3, further comprising a diagram data storage unit which stores the diagram data created, wherein the diagram display processing unit reads the diagram data from the diagram data storage unit based on the track section code related to the track section displayed on the diagram creation screen, and displays the diagram line based on the diagram data in the diagram, and when the diagram line based on the diagram data is changed on the diagram creation screen, the diagram data creating unit creates new diagram data based on the diagram line changed, and updates the diagram data storage unit.

5. A diagram creating method comprising:

a track section determining step of determining a track section related to a target track section whose diagram indicating a relationship between a kilometer and a time is displayed and created by referring to a track section master which stores names of a plurality of track sections in a railroad network including the plurality of track sections and track section codes for identifying the names as track section data;

a train order data reading step of reading station order data using as a key the track section code determined in the track section determining step, from a station order master which stores a relationship between the track section codes, a station order code indicating an order from a reference station in the same track section, a station name and a kilometer from the reference station as station order data;

a junction data reading step of reading junction data using as keys the track section codes and the station order code included in the station order data read in the station order data reading step, from a junction master which stores a relationship between the track section codes related to a junction station belonging to the plurality of the track sections, the station order code and a junction destination track section code as junction data;

a diagram creation screen displaying step of drawing a station line representing the kilometer of a station included in the target track section based on the station order data and displaying the station name in association with the station line, and displaying a diagram creation screen including the diagram with a junction button associated with the junction destination track section code;

a track section switching step of, when the junction button is pushed, switching part of the station line related to the target track section in the diagram, to the station line subsequent to the junction station belonging to the another track section with the junction station as a starting point based on the junction destination track section code, and displaying the station line; and a diagram data creating step of analyzing a coordinate of a diagram line drawn as a continuous line in the diagram on the diagram creation screen, and creating diagram data indicating a relationship between the track section code related to a track section in which the train travels, a departure station, an arrival station, a departure time and an arrival time.

6. A diagram display program which can be stored in a non-transient storage medium and causes a computer to execute:

a track section determining function which determines names of a plurality of track sections in a railroad network and track section codes for identifying the names, as display targets of a diagram indicating a relationship between a kilometer and a time;

a station order reading function which reads a relationship between a station order code indicating an order from a reference station, a station name and a kilometer from the reference station in the same track section associated with the track section code determined by the track section determining function;

a junction data reading function which reads a junction destination track section code indicating a junction destination track section in association with the track section code and the station order code and indicating that a station is a junction station; and a display function which draws a station line representing the kilometer of a station included in the target track section based on the relationship between the track section code, the station order code, the station name and the kilometer from the reference station and displays the station name in association with the station name, and displays a diagram creation screen including the diagram with a junction display indicating portion associated with the junction destination track section code.

7. The diagram display program according to claim 6, wherein the junction display indicating portion is a junction button, and the junction button is displayed near a station name of the junction station.

8. The diagram display program according to claim 7, further comprising a track section switching function which, when the junction button is pushed, switching part of the station line related to the target track section in the diagram, to the station line subsequent to the junction station belonging to the another track section with the junction station as a starting point based on the junction destination track section code, and displaying the station line.

9. The diagram display program according to claim 8, further comprising a diagram data creating function which analyzes a coordinate of a diagram line drawn as a continuous line in the diagram on the diagram creation screen, and creates diagram data indicating a relationship between the track section code related to a track section in which the train travels, a departure station, an arrival station, a departure time and an arrival time.

10. The diagram display program according to claim 9, further comprising a diagram data storage function which stores the diagram data created, wherein the display function reads the diagram data stored in the diagram data storage function based on the track section code related to the track section displayed on the diagram creation screen, and displays the diagram line based on the diagram data in the diagram, and when the diagram line based on the diagram data is changed on the diagram creation screen, the diagram data creating function creates new diagram data based on the diagram line changed, and updates the diagram data stored by the diagram data storage function.

11. The diagram display program according to claim 6, wherein the track section determining function further determines a track section code related to a target track section whose diagram indicating a relationship between the kilometer and a time is displayed by referring to a track section master which stores names of the track sections and track section codes as track section data;

the train order data reading function further reads the station order data using as a key the track section code determined by the track section determining function, from a station order master which stores a relationship between the track section codes, the station order code, the station name and a kilometer from the reference station as station order data; and the junction data reading function further reads the junction data using as keys the track section codes and the station order code included in the station order data read by the station order data reading function, from a junction master which stores a relationship between the track section codes related to a junction station belonging to the plurality of track sections, the station order codes and the junction destination track section code as junction data.

12. The diagram display program according to claim 7, wherein the junction data reading function further reads a junction destination track section direction in which a junction destination track section indicates an order from a reference station as an ascending order or as a descending order, and the display function arranges the junction button on a lower side of the junction station in the case of the ascending order, and arranges the junction button on an upper side of the junction station in the case of the descending order.

* * * * *